United States Patent [19]

Cans et al.

[11] Patent Number: 4,523,627

[45] Date of Patent: Jun. 18, 1985

[54] PROCESS FOR HIGH-SPEED VERTICAL CONTINUOUS CASTING OF ALUMINIUM AND ALLOYS THEREOF

[75] Inventors: Yves Cans, Saint Egreve; Richard Gonda, Le Grand Lemps; Marc Tavernier, Voiron, all of France

[73] Assignee: Societe de Vente de L'Aluminium Pechiney, Paris, France

[21] Appl. No.: 474,669

[22] PCT Filed: Jul. 7, 1982

[86] PCT No.: PCT/FR82/00115

§ 371 Date: Mar. 7, 1983

§ 102(e) Date: Mar. 7, 1983

[87] PCT Pub. No.: WO83/00107

PCT Pub. Date: Jan. 20, 1983

[51] Int. Cl.[3] ..... B22D 27/02

[52] U.S. Cl. ..... 164/467; 164/503

[58] Field of Search ..... 164/467, 503, 147.1, 164/498

[56] References Cited

U.S. PATENT DOCUMENTS 4,236,570 12/1980 Gaule et al. ..... 164/467

FOREIGN PATENT DOCUMENTS 2902473 8/1979 Fed. Rep. of Germany ..... 164/467

*Primary Examiner*—Kuang Y. Lin

*Attorney, Agent, or Firm*—Oblon, Fisher, Spivak, McClelland & Maier

[57] ABSTRACT

The present invention concerns a process for vertical continuous casting at speeds which are close to a meter per minute. The process is characterized in that the use of a top feeder head and an electromagnetic field are combined and that, by controlling the position in respect of height of the top feeder head and the cooling system relative to the field generating means, the distances between certain parameters such as the solidification front and the base plane of the top feeder head are maintained constant in the course of the casting operation. This process makes it possible to cast aluminium and alloys thereof in the form of billets or plates, the smallest dimension of which does not exceed 150 mm and which have a surface that does not require any scalping treatment.

6 Claims, 1 Drawing Figure

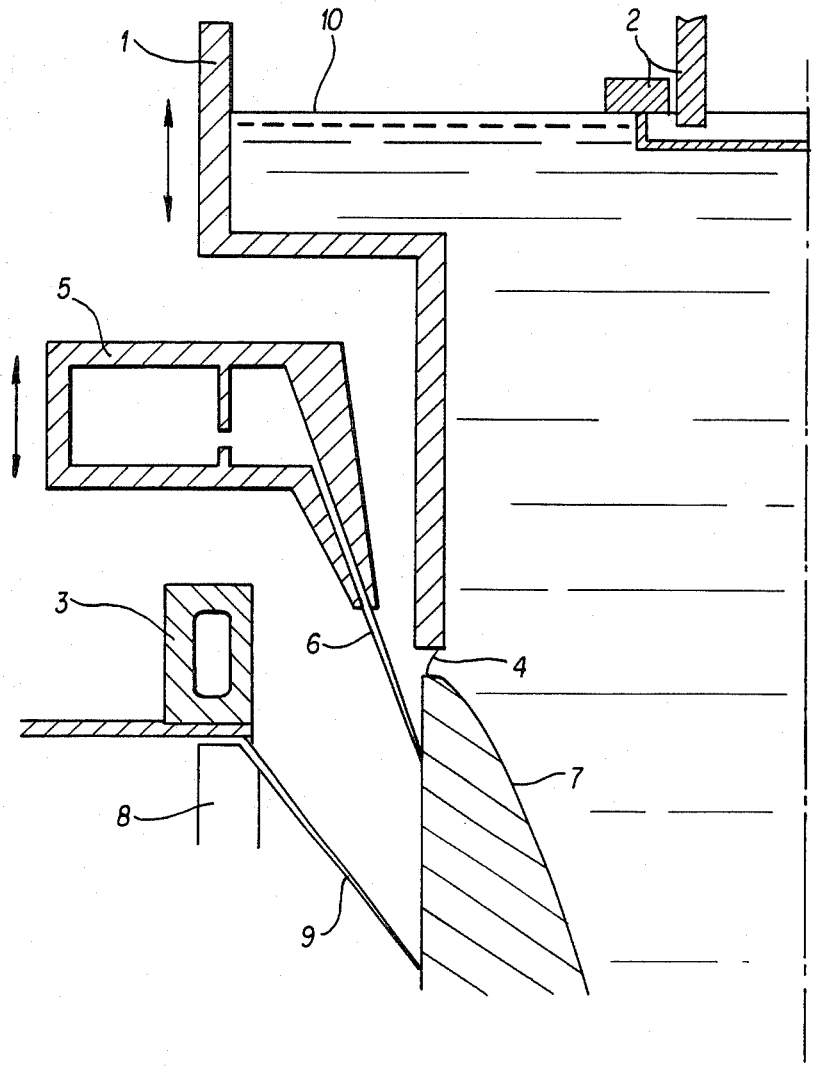
1
10
2
5
3
6
4
7
8
9

PROCESS FOR HIGH-SPEED VERTICAL CONTINUOUS CASTING OF ALUMINIUM AND ALLOYS THEREOF

The present invention relates to a process for high-speed vertical continuous casting of aluminium and alloys thereof, in particular in the form of billets and plates, the smallest dimension of which does not exceed 150 mm.

The man skilled in the art has long had knowledge of the vertical casting process wherein a metal in a liquid condition is continuously moulded by passing downwardly through a cooled, bottomless mould, to form billets or plates of greater or lesser length.

As the decades have passed, that process has been improved for the purposes of enhancing the levels of performance thereof, both from the point of view of production capacity and from the quality aspect.

In seeking to achieve higher casting speeds, problems relating to surface defects have been encountered, being both physical, namely an irregular skin, and chemical, namely inverse segregation phenomena, which at first have been overcome in a rather unsatisfactory manner, by carrying out intermediate scalping operations on the castings. Then, different measures concerning the materials used for the moulds and the lubrication thereof, cooling devices, and the casting programme made it possible to reduce and in some cases even omit the scalping operation.

More recently, and particularly in order in particular to obtain products which can be used directly for transformation operations, recourse has been had to particular shaping equipment, such as for example the HOT-TOP wherein a top feeder head is disposed above the ingot mould, being a sort of reservoir of liquid metal which is similar in section to the section of the cast product and which is variable in height, being formed by a refractory and insulating material.

Such an apparatus results in products which are improved in regard to the surface condition, but, depending on the type of alloy cast, it is found that there is an optimum speed which is not to be exceeded, as otherwise the skin or surface layer of the casting suffers from tearing effects. Although it is possible to restrict that defect by associating the top feeder heads with moulds which are of small height, nonetheless such a coupled assembly cannot be used in relation to plates which are close to 150 mm in thickness because, by virtue of deformation thereof at the moment of starting to move, they may cause damage to the feeder head, in particular when the diameter of the feeder head is less than that of the ingot mould.

Under these conditions, it is found that, if there is a need to cast high-quality billets with a diameter of 100 mm, even with a mould which is 1.5 cm in height, the best speed which can be attained, with the most suitable alloy, is 300 mm/min, which is also confirmed by French Pat. No. 2,249,728.

Another way of reducing the occurrence of defects at the surface of the castings comprises carrying out the moulding operation without any contact with a mould. This can be achieved by passing the liquid metal through the centre of an induction means which creates an electromagnetic field and thus generates forces which contribute to imparting a properly defined shape to the liquid. That shape is then maintained by causing the metal to solidify, by spraying it directly with a heat exchange fluid.

It is beyond all doubt that such a process made it possible substantially to improve the surface condition of the castings and substantially to reduce the occurrence of inverse segregation, but it does suffer from some disadvantages. Thus, using that process necessitates maintaining a constant height of liquid metal above the interface with the solidified metal. In order to achieve the aim, use is made of a nozzle-float assembly which is somewhat bulky and which is particularly difficult to set in position when the aim involved is that of casting components, one of the dimensions of which does not exceed 150 mm. In addition, if the speed of casting is to be increased beyond certain values, turbulence is caused at the location of the nozzle-float assembly, and such turbulence results in deformation of the meniscus of the metal and the formation of undulations or ripples at the surface of the casting. In addition, such deformation may move the level of the molten metal to the line of flight of the heat exchange fluid or may result in the formation of a skin which will still be thin at the moment at which it escapes from the action of the field and accordingly will tear under the effect of metallostatic pressure, or once again such deformation may cause the skin to be re-melted. The effect of such consequences will be to increase the surface defects of the casting, without mentioning the risk run by the operating personnel, because of the dangers of explosion.

Such difficulties mean that, in the case of billets which are 150 mm in diameter, it is difficult to achieve casting speeds of higher than 300 mm/minute.

The present applicants, in seeking to arrive at casting billets or plates with a smallest dimension of not more than 150 mm, at a casting speed of more than 500 mm/min, sought and developed a process which permits the above-indicated difficulties to be overcome.

This vertical continuous casting process combines the use of a hot-top or feeder head for the supply of liquid metal, an electromagnetic induction means and a direct cooling means for shaping the product to be produced. It is characterized in that the position of the top feeder head is controlled by a vertical movement with respect to the induction means which generates the field in such a way that, in the course of the casting operation, a constant distance is maintained below the base plane of the top feeder head and the plane passing through the solidification front at the periphery of the cast product.

Thus, the applicants use a conventional top feeder head which is close in cross-section to the cast product and which is open at its two ends and in which the liquid metal is adjusted to a certain height by means of a suitable feed system. Disposed outside the feeder head and approximately at the same level is an annular cooling means which sprays the cast product over the entire periphery thereof at a distance from the base plane of the feeder head such that solidification of the metal is initiated below that plane, and that a region of non-confined liquid is maintained over the entire section of the cast product.

It is over the above-mentioned region of non-confined liquid that the action of the field generated by the induction means is applied, the effect thereof being to counterbalance the metallostatic pressure of the liquid contained in the feeder head and to impart a given profile to the non-confined liquid.

In operation, solidification begins at the periphery of the product, along a line contained in a plane which is generally perpendicular to the axis of the casting if the cooling means is suitably positioned, and is propagated approximately symmetrically and progressively inwardly and downwardly of the casting until, at a greater or lesser distance from the top feeder head, contact between the liquid and solid phases is reduced to a point or a portion of a straight line along the section of the casting. The limit between the phases is referred to as the solidification front.

Such a system does not permit the desired casting speeds to be attained, as the solidification front is not stable and is shifted increasingly downwardly in proportion to increasing speed. This results in an increase in the length of the region of nonconfined liquid such that the action of the generated field is found to be insufficient, resulting in the formation, before solidification, of an abnormal profile or even resulting in metal breaking or running out from the mould.

The applicants have overcome that problem by controlling the position of the top feeder head by a vertical movement with respect to the induction means in such a way as to maintain a constant distance between the base plane of the top feeder head and the plane passing through the solidification front at the periphery of the casting. In fact, when the solidification front tends to move away from the feeder head, the above-indicated control action makes it possible to maintain the region of non-confined liquid at a height which is compatible with regular geometry of the casting. The above-indicated height is maintained at a value of less than 15 mm and preferably 10 mm without ever being zero, in which case solidification would occur within the feeder head and would result in a poor surface condition.

With the position of the feeder head thus being linked to the position of the solidification front, the position of the front must first be detected. The position of the front may be detected using any means known to the man skilled in the art, for example, probes, or by making use of mathematical relationships which give the position of the front with respect to the point of impact of the water, in dependence on the casting speed. The position of the top feeder head is then adjusted by moving it vertically by means of any system which may be controlled on the basis of detection of the position of the front.

The applicants have also found that movement of the feeder head may be combined with movement of the cooling means.

It should first be known that the region of impact of the heat exchange fluid, particularly when it is water, must be outside the region of non-confined liquid, as otherwise there will be a chemical reaction with the aluminium, and the danger of an explosion. Consequently, the jet of fluid is directed towards the solid part of the casting.

In the equilibrium condition of operation, the solidification front occurs at a constant distance above the impact region; it is therefore possible for the position of the front to be adjusted by controlling the movement of the cooling means.

When the casting speed is increased, it has been seen that the front moved downwardly; if the rate of acceleration is low, the process remains close to the equilibrium conditions, and the solidification front can be maintained, while leaving the cooling means stationary; on the other hand, if the rate of acceleration is high, the system is moved into a condition of non-equilibrium and the cooling means must be moved downwardly in order to avoid spraying the liquid region of the casting. Preferably, the upper limit of the region which is sprayed by the fluid of the cooling means is at a distance of from 1 to 6 mm from the front.

When the system has reached the cruising condition of operation, the cooling means can be progressively moved upwardly again in order to move the front upwardly to a position close to the middle of the induction means, which is the best position for casting. As the top feeder head has been moved downwardly, as indicated above, in order to maintain the region of non-confined liquid at a constant height, the feeder head can now be moved up again, following the upward movement of the front. The system thus progressively returns to the initial positions of the feeder head and the cooling means, and a fresh acceleration procedure can thus be formed.

In this way, the combination of the two movements permits a greater increase in speed.

Here too, the movement of the cooling means may be produced by any suitable system.

The above-indicated adjustments in respect of distance are fairly precise and therefore require the impact regions to be clearly defined. This is achieved by a means which produces flat peripheral jets or sheets of water, which are less than one millimeter in thickness and which are at a small angle to the vertical, between 10° and 30°. The fluid must also be propelled at high speed in order to avoid calefaction phenomena; the pressure applied is generally sufficient to give a speed of at least 1 meter/sec.

Nonetheless, it is not possible for a sufficient amount of fluid to produce complete solidification to be discharged at that location. It is for that reason that the cooling effect is supplemented by means of an additional stage.

The additional stage may comprise any means for distributing flat jets or droplets. However, the requirements in regard to the degree of accuracy of the impact of the cooling fluid are less severe. For example, it is possible to use flat jets or sheets which are 2 mm in thickness and which are directed downwardly at an angle of more than 45°, and which are propagated at a speed of more than 3 meters/sec.

In the course of the casting operation, the level of liquid in the feeder head may vary in such a way that the height above the solidification front, at the periphery of the product, is from 20 to 80 mm.

The invention will be better appreciated by reference to the drawing accompanying the present application, showing a casting assembly for carrying out the process according to the invention.

Referring to the drawing, the following components are shown therein:

the movable hot-top or top feeder head 1 having an enlarged upper portion so as to facilitate fitting the nozzle-float feed system 2 and a lower portion whose section is close to that of the cast product, the induction means 3 for generating the electromagnetic field which acts on the region 4 of liquid metal disposed below the feeder head, the movable cooling means 5 which is disposed around the feeder head and which discharges a flat peripheral jet of water 6 to a position below the solidification front 7, and an additional cooling stage 8 which is disposed below the induction means and which produces a jet of fluid at 9.

In operation, the nozzle-float system maintains the level of liquid metal 10 at a suitable height while movement of the feeder head and the cooling means is controlled in such a way as to spray fluid onto the casting immediately below the front, and to cause the front to move upwardly again, irrespective of the speed of casting, to the level of the middle of the induction means, and to maintain a constant distance between the base plane of the feeder head and the solidification front.

The invention will now be illustrated by means of the following examples:

EXAMPLE 1

Using an installation comprising a top feeder head which is 120 mm in inside diameter and 80 mm in height, a cooling means which discharges 3 $m^3$/hour of water in the form of a flat jet which is 0.8 mm in thickness and which is inclined at 30° with respect to the vertical, flowing at a speed of 2.5 meters/sec, an induction means which is supplied at a voltage of 10 V with a current strength of 4200 A at a frequency of 2000 Hz, and an additional cooling means which discharges 6 $m^3$/hour of water in the form of a flat jet which is 1 mm in thickness and which is inclined at 45° with respect to the vertical, with a flow speed of 3.5 meter/sec, a billet was cast, being 120 mm in diameter, comprising an aluminium alloy 5754, at a speed of 900 mm/minute, with a distance of 13 mm being maintained between the base plane of the feeder head and the plane passing through the solidification front, and a distance of 1 mm between the upper limit of the region sprayed with cooling fluid and the solidification front.

The height of the liquid metal above the solidification front as detected at the periphery of the product varied between 30 and 50 mm.

EXAMPLE 2

Using an installation comprising a top feeder head with an inside section of 100×200 mm and a height of 80 mm, a cooling system discharging 4 $m^3$/hour of water in the form of a flat jet which is 0.7 mm in thickness and which is inclined at 15° with respect to the vertical, at a flow rate of 2.5 meters/sec, an induction means supplied at a voltage of 18 V with a current strength of 6300 A at a frequency of 2000 Hz, and an additional cooling means discharging 15 $m^3$/hour of water in the form of two flat jets which are 1 mm in thickness and which are inclined at an angle of 45° with respect to the vertical, at a flow rate of 3.2 meters/sec, a plate measuring 100×200 mm was cast from an aluminium alloy 1050 at a speed of 960 mm/minute, with a distance of 8 mm being maintained between the base plane of the feeder head and the plane passing through the solidification front, and a distance of 2 to 3 mm between the upper limit of the sprayed region and the solidification front.

EXAMPLE 3

Using an installation comprising a top feeder head with an inside section of 100×1300 mm and a height of 80 mm, a cooling means which discharges 17 $m^3$/hour of water in the form of a flat jet which is 0.7 mm in thickness and inclined at an angle of 15° with respect to the vertical, at a flow rate of 2.4 meters/sec, an induction means supplied with power at a voltage of 19 V and a current strength of 5900 A at a frequency of 2000 Hz, and a supplementary cooling means which discharges at a rate of 80 $m^3$/hour in the form of four flat jets which are 1 mm in thickness and inclined at 45° with respect to the vertical, at a flow rate of 2.0 meters/sec, a plate measuring 100×1300 mm was cast from an aluminium alloy 1050 at a speed of 780 mm per minute, with a distance of 14 mm being maintained between the base plane of the feeder head and the plane passing through the solidification front, and a distance of 4 mm between the upper limit of the sprayed region and the solidification front.

The present invention permits continuous casting of aluminium and alloys thereof at speeds of higher than 500 mm/minute, in the form of billets or plates of which the smallest dimension does not exceed 150 mm and which have a surface that does not require any scalping treatment.

What is claimed as new and desired to be secured by letters patent of the United States is:

1. A process for the vertical continuous casting of aluminum and alloys thereof in the form of billets or plates, the smallest dimension of which does not exceed 150 mm, at a speed greater than 500 mm/minute, comprising:

(a) feeding liquid metal into a moulding zone by means of a top feeder head;

(b) shaping said liquid metal discharged from said feeder head by applying an electromagnetic field generated by an induction means;

(c) cooling said liquid metal by an annular cooling means disposed around said feeder head, thereby initiating solidification of said liquid metal by forming an outer shell in the periphery region, wherein the base plane of said top feeder head and the solidification front are separated by liquid metal;

(d) continuing the shaping of said liquid metal by spraying water onto the outer surface of said outer shell by said annular cooling means, wherein the distance between the base plane of said top feeder head and the plane passing through the solidification front at the periphery region of the solidified product is kept constant by vertically controlling the position of said top feeder head with respect to said induction means; and (e) recovering a cast product therefrom.

2. The process according to claim 1 wherein a constant distance of less than 15 mm is maintained between the base plate of said top feeder head and the plane passing through the solidification front.

3. The process according to claim 1 wherein the position of said annular cooling means is controlled by vertically moving its position with respect to the position of said induction means.

4. The process according to claim 3 wherein said outer shell sprayed with the fluid of the cooling means is between 1 to 6 mm from said front.

5. The process according to claim 3 wherein the cooling means emits a peripheral flat jet of water, less than 1 millimeter in thickness and at an angle of less than 30° with respect to the vertical axis and is propagated at a speed of more than 1 meter/second.

6. The process according to claim 1 further comprising the application of an additional cooling stage to the cast product.

* * * * *

UNITED STATES PATENT AND TRADEMARK OFFICE

CERTIFICATE OF CORRECTION

PATENT NO. : 4,523,627

DATED : June 18, 1985

INVENTOR(S) : Cans et al

It is certified that error appears in the above-identified patent and that said Letters Patent is hereby corrected as shown below:

--[30] The priority information has been omitted, should read as follows:

FRANCE 81 14037 07/09/1981--

Signed and Sealed this

*Nineteenth* Day of *November 1985*

[SEAL]

*Attest:*

DONALD J. QUIGG

*Attesting Officer*

*Commissioner of Patents and Trademarks*